US007852229B1

(12) United States Patent
Gohl

(10) Patent No.: US 7,852,229 B1
(45) Date of Patent: Dec. 14, 2010

(54) EXCAVATION EQUIPMENT ALARM SYSTEM

(76) Inventor: Russell R. Gohl, 2807 8th St. SE., Minot, ND (US) 58701

( * ) Notice: Subject to any disclaimer, the term of this patent is extended or adjusted under 35 U.S.C. 154(b) by 352 days.

(21) Appl. No.: 12/210,235

(22) Filed: Sep. 15, 2008

(51) Int. Cl.
*G08B 21/00* (2006.01)

(52) U.S. Cl. ..... 340/685; 340/686.1; 212/279

(58) Field of Classification Search ..... 340/679, 340/685, 686.1, 686.3, 686.5, 686.6; 212/178, 212/278, 279; 180/287, 289; 324/326
See application file for complete search history.

(56) References Cited

U.S. PATENT DOCUMENTS 3,590,760 A * 7/1971 Boyd et al. ..... 144/4.1
5,199,583 A * 4/1993 Weider et al. ..... 212/279
7,132,924 B2 * 11/2006 Kajita et al. ..... 340/5.3
2009/0030580 A1 * 1/2009 Doi ..... 701/50

FOREIGN PATENT DOCUMENTS

JP 2002115276 A * 4/2002

* cited by examiner

*Primary Examiner*—Van T. Trieu
(74) *Attorney, Agent, or Firm*—Neustel Law Offices

(57) ABSTRACT

An excavation equipment alarm system for providing advance warning to an operator of an excavator of overhead obstacles. The excavation equipment alarm system generally includes a support member attached to the actuator, a guide tube attached to the support member, a guide arm slidably positioned within the guide tube, a mounting post attached to a distal end of a telescoping arm of the actuator and to the guide arm, and a magnetic sensor attached to the actuator to detect a distal end of guide arm. If the magnetic sensor detects the presence of the guide arm, then the warning unit is not activated. If the magnetic sensor no longer detects the presence of the guide arm, then the warning unit is activated to warn the operator of the excavator that the boom of the excavator may be at an unsafe height.

20 Claims, 6 Drawing Sheets

EXCAVATION EQUIPMENT ALARM SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to excavators and more specifically it relates to an excavation equipment alarm system for providing advance warning to an operator of an excavator of overhead obstacles.

2. Description of the Related Art

Any discussion of the related art throughout the specification should in no way be considered as an admission that such related art is widely known or forms part of common general knowledge in the field.

Excavators are utilized to remove dirt and debris from a ground surface. FIGS. 4 and 5 illustrate an exemplary excavator that includes a boom having multiple segments. An actuator (typically hydraulic cylinder) is attached to the main portion of the excavator with the telescoping arm attached to the first segment of the boom to lift and lower the boom.

One of the problems with conventional excavators is that the operator may have a difficult time determining the height of the boom during operation or the proximity of the boom to an overhead obstruction (e.g. power line, building structure). Because of the difficulty encountered by excavator operators in judging the height of the boom, the boom unfortunately is prone to engaging the overhead obstacle thereby resulting in damage to the overhead obstacle, the excavator and/or the excavator operator.

Because of the inherent problems with the related art, there is a need for a new and improved excavation equipment alarm system for providing advance warning to an operator of an excavator of overhead obstacles.

BRIEF SUMMARY OF THE INVENTION

The general purpose of the present invention is to provide an excavation equipment alarm system that has many of the advantages of the excavators mentioned heretofore. The invention generally relates to an accessory for an excavator which includes a support member attached to the actuator, a guide tube attached to the support member, a guide arm slidably positioned within the guide tube, a mounting post attached to a distal end of a telescoping arm of the actuator and to the guide arm, and a magnetic sensor attached to the actuator to detect a distal end of guide arm. If the magnetic sensor detects the presence of the guide arm, then the warning unit is not activated. If the magnetic sensor no longer detects the presence of the guide arm, then the warning unit is activated to warn the operator of the excavator that the boom of the excavator may be at an unsafe height.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide an excavation equipment alarm system for providing advance warning to an operator of an excavator of overhead obstacles.

Another object is to provide an excavation equipment alarm system that prevents the booms of an excavator from engaging an overhead obstacle such as but not limited to overhead power lines.

An additional object is to provide an excavation equipment alarm system that helps reduce accidents and injuries to excavator operators.

A further object is to provide an excavation equipment alarm system that may be utilized upon any excavation machinery with booms that extend upwardly during operation.

Another object is to provide an excavation equipment alarm system that provides a visual and an audible warning alarm.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
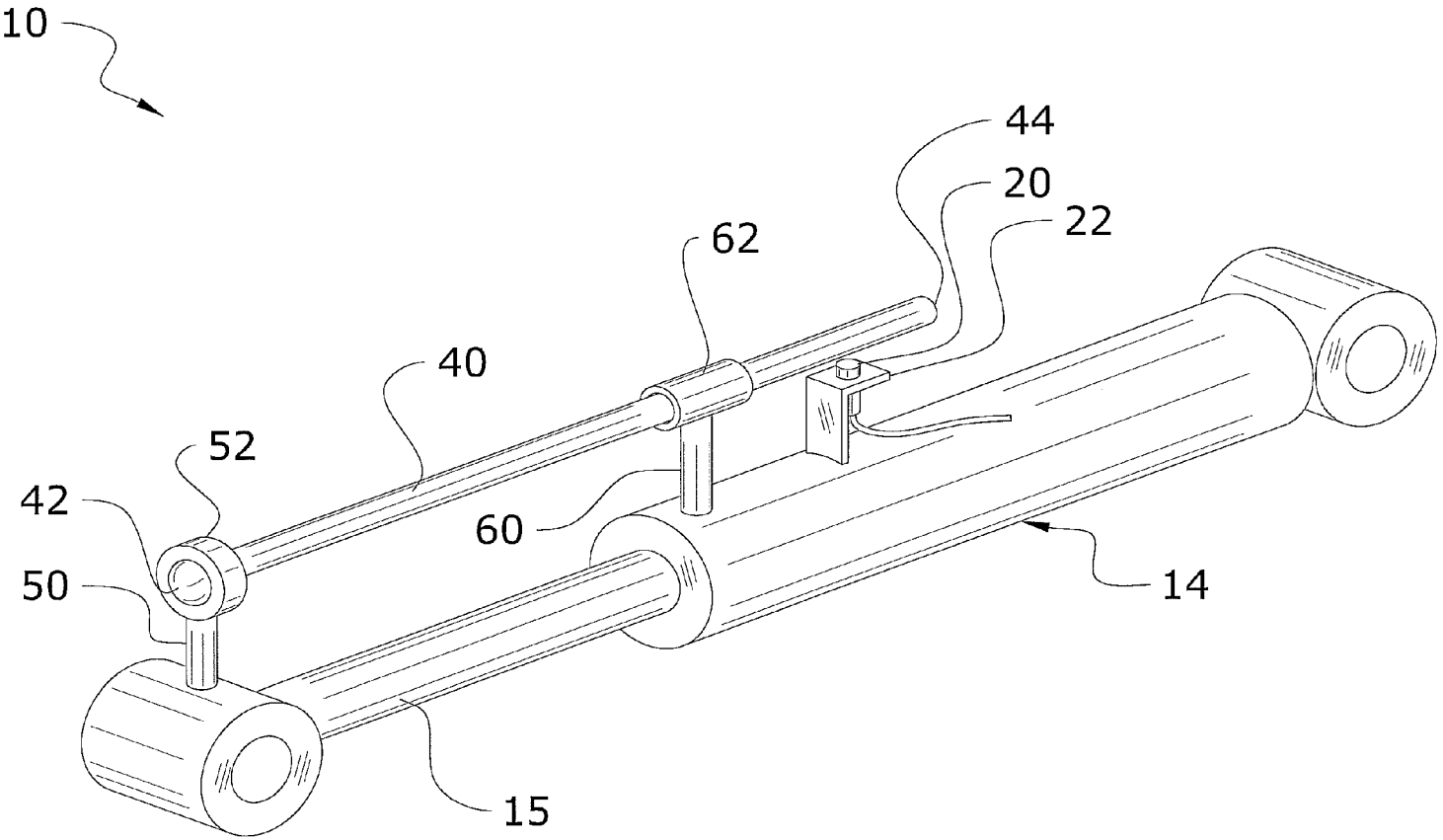
FIG. 1 is an upper perspective view of the present invention attached to an actuator.

Turning now descriptively to the drawings, in which similar reference characters denote similar elements throughout the several views, FIGS. 1 through 6 illustrate an excavation equipment alarm system 10, which comprises a support member 60 attached to the actuator 14, a guide tube 62 attached to the support member 60, a guide arm 40 slidably positioned within the guide tube 62, a mounting post 50 attached to a distal end 44 of a telescoping arm 15 of the actuator 14 and to the guide arm 40, and a magnetic sensor 20 attached to the actuator 14 to detect a distal end 44 of guide arm 40. If the magnetic sensor 20 detects the presence of the guide arm 40, then the warning unit 30 is not activated. If the magnetic sensor 20 no longer detects the presence of the guide arm 40, then the warning unit 30 is activated to warn the operator of the excavator 16 that the boom 18 of the excavator 16 may be at an unsafe height.

B. Excavator

Figure 4:
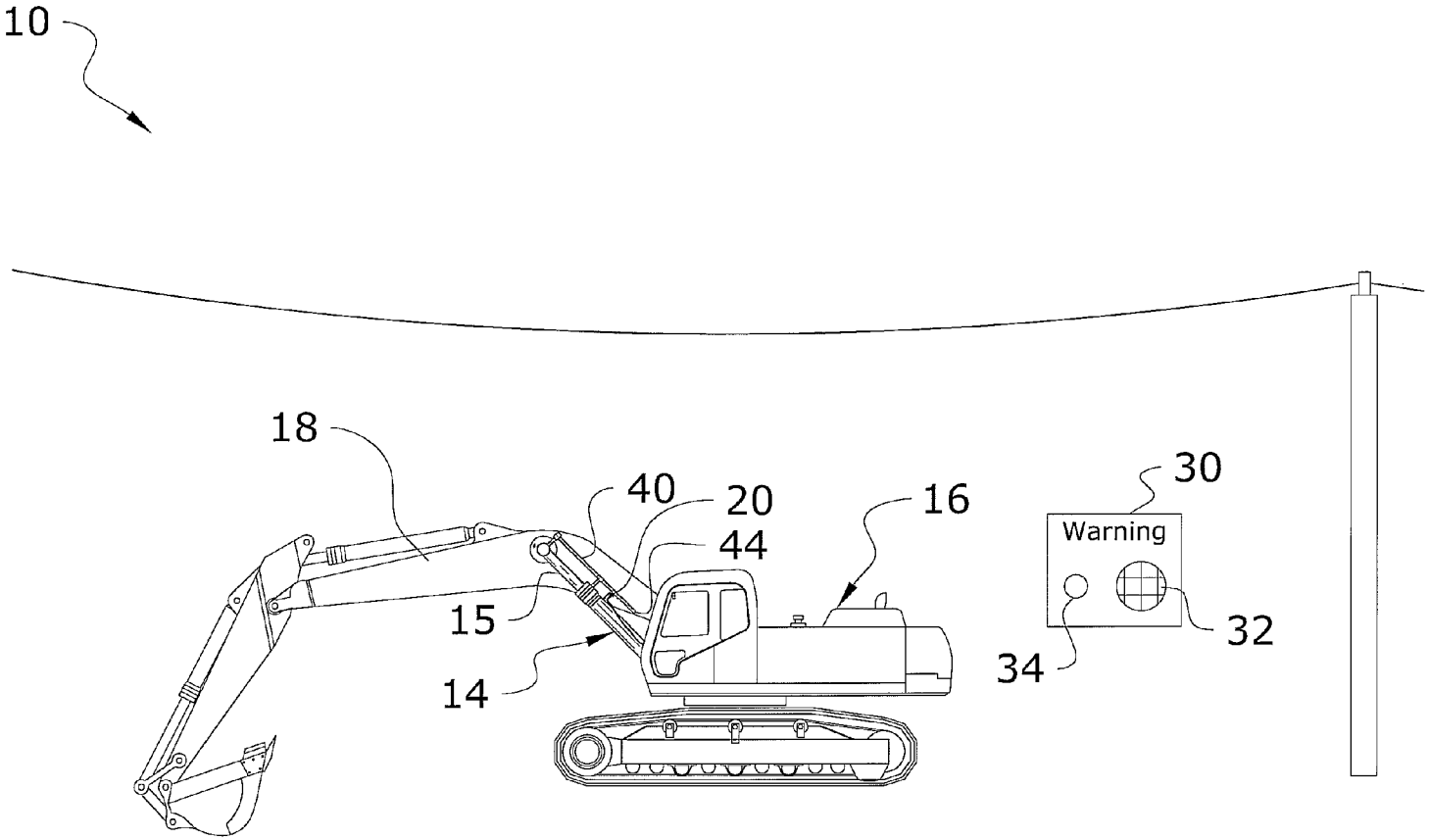
FIG. 4 is a side view of the present invention attached to an actuator on an excavator with the boom in normal and safe operation.
Figure 5:
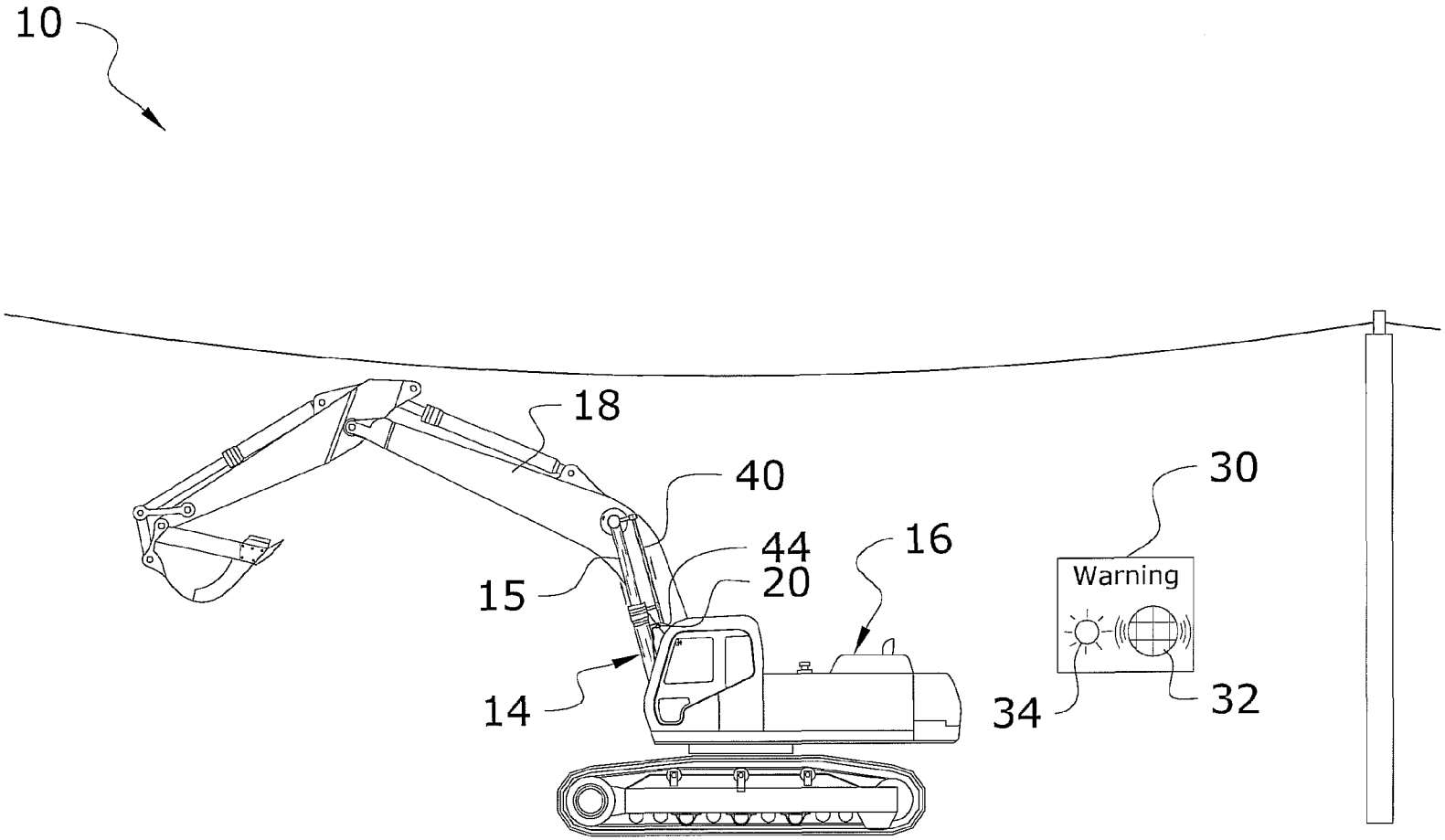
FIG. 5 is a side view of the present invention attached to an actuator on an excavator with the boom raised near an unsafe height with the warning unit activated.

FIGS. 4 and 5 illustrate an exemplary excavator 16. The excavator 16 may be comprised of any machine capable of excavating dirt and debris from a ground surface that has a boom 18 that is raised and lowered by an actuator 14. As shown in FIGS. 4 and 5, the boom 18 of the excavator 16 typically has multiple segments pivotally connected to one another. As shown in FIGS. 4 and 5, an actuator 14 (usually a hydraulic cylinder) having a telescoping arm 15 is connected between the main body of the excavator 16 and the first segment of the boom 18 to lift and lower the boom 18 to various heights as controlled by the operator of the excavator 16.

C. Guide Arm

Figure 2:
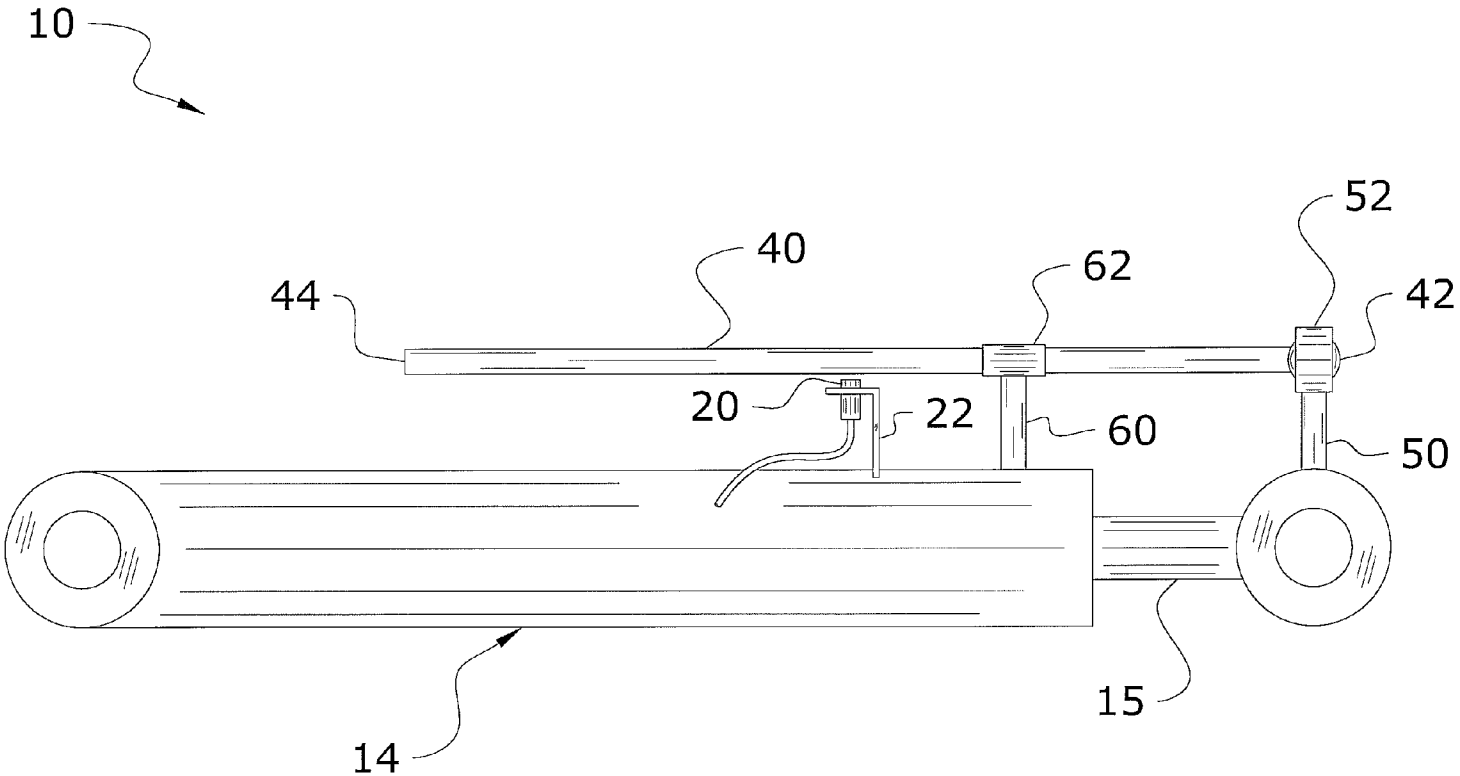
FIG. 2 is a side view of the present invention attached to an actuator.
Figure 3:
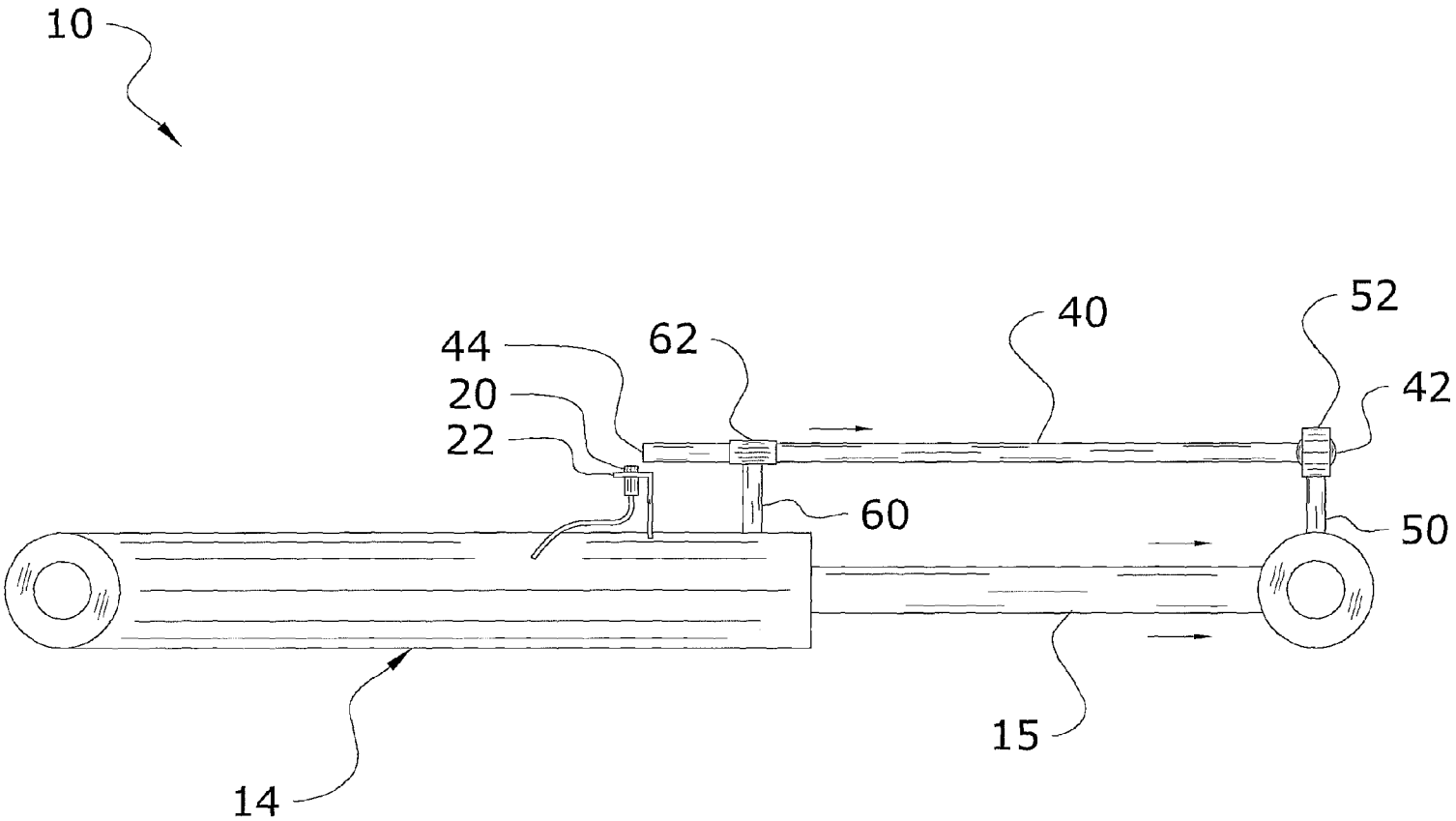
FIG. 3 is a side view of the present invention attached to an actuator with the telescoping arm of the actuator extended past a warning point.

FIGS. 1 through 3 illustrate a guide arm 40 including a connecting end, a distal end 44 and a length between the connecting end and the distal end 44. The length between the connecting end and the distal end 44 is preferably greater than the exposed portion of the telescoping arm 15 to allow the distal end 44 to be positioned above the body of the actuator 14 as best illustrated in FIG. 3 of the drawings. The length of the guide arm 40 may be adjusted by cutting the guide arm 40, replacing the guide arm 40 with a different length or adjusting the length of the guide arm 40 with respect to the telescoping arm 15 (e.g. threaded structure).

As shown in FIGS. 1 through 3 of the drawings, the connecting end of the guide arm 40 is attached to the telescoping arm 15. The guide arm 40 extends from the distal portion of the telescoping arm 15 back to over the body of the actuator 14 as shown in FIGS. 2 and 3. The connecting end of the guide arm 40 may be attached in a non-movable manner or a movable manner. FIGS. 1 through 3 illustrate the usage of a swivel joint 52 attached to a mounting post 50 that receives a swivel member 42 that the guide arm 40 is attached to allowing movement of the guide arm 40 along multiple axes during operation. The mounting post 50 is attached to the distal portion of the telescoping arm 15 and extends outwardly in a direction similar to the support member 60 and the magnetic sensor 20.

As shown in FIGS. 2 and 3, the guide arm 40 is preferably substantially parallel with respect to the actuator 14 to avoid interference with the movement of the guide arm 40. The guide arm 40 is preferably comprised of a metal material that is detectable by the magnetic sensor 20 and in particular is preferably comprised of an elongated metal rod.

As shown in FIGS. 1 through 3, a support member 60 is preferably attached to the body of the actuator 14 extending outwardly a distance to keep the guide arm 40 away from the body of the actuator 14. A guide tube 62 is preferably attached to the support member 60 and the guide arm 40 slidably extends through the guide tube 62 as shown in FIGS. 2 and 3 of the drawings. The guide tube 62 supports and guides the guide arm 40 during movement thereof based upon the extension of the actuator 14.

D. Sensor

A sensor is attached to the actuator 14 and positioned near the guide arm 40 to detect the presence of the guide arm 40. The sensor is preferably comprised of a magnetic sensor 20 that detects the metal guide arm 40 and when the distal end 44 of the guide arm 40 passes away from the sensor. A mounting bracket 22 is preferably attached to a body of the actuator 14 and extends away from the body of the actuator 14, wherein the sensor is attached to the mounting bracket 22 as shown in FIGS. 1 through 3 of the drawings.

E. Warning Unit

Figure 6:
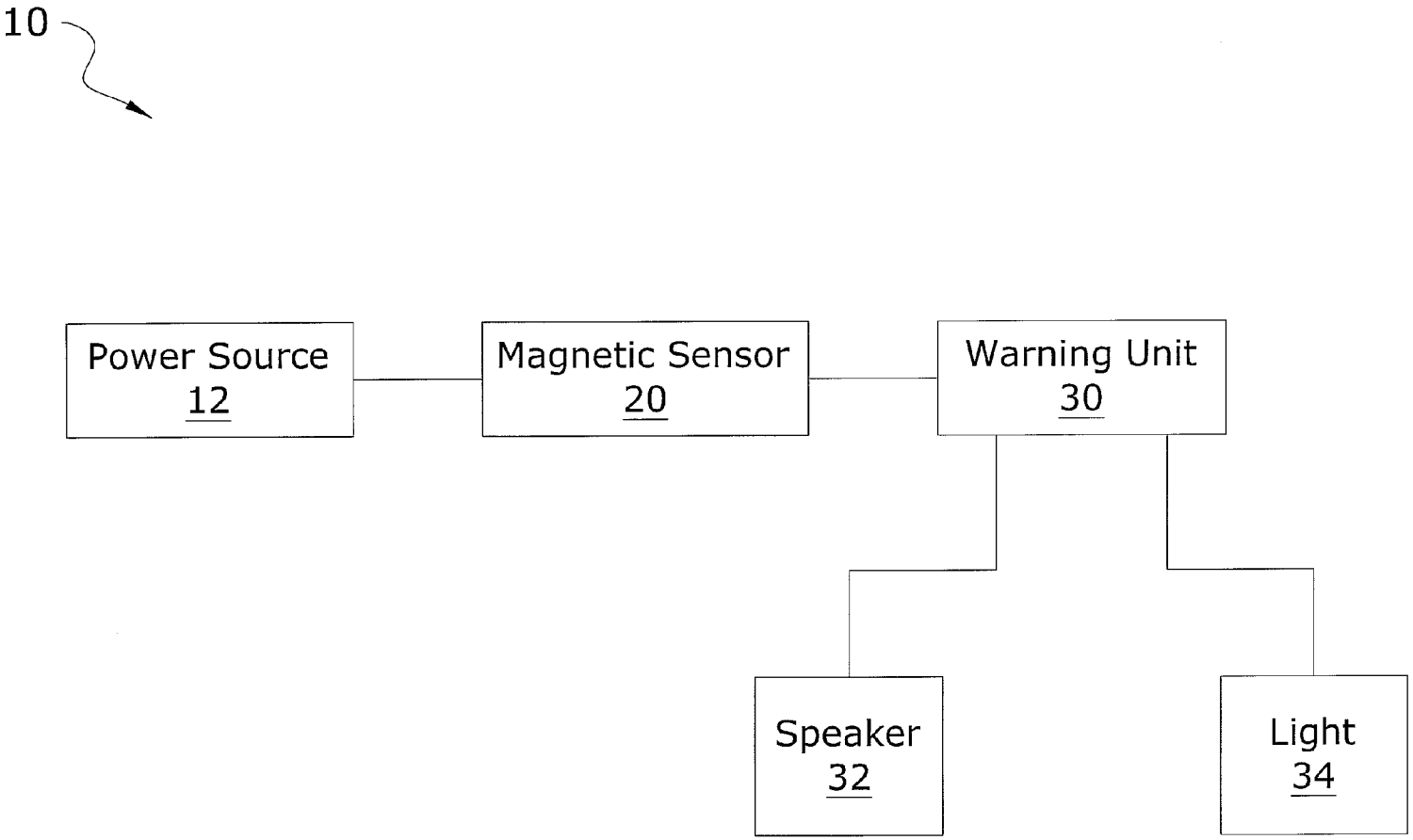
FIG. 6 is a block diagram of the electrical components of the present invention.

A warning unit 30 is in communication with the sensor as shown in FIG. 6 of the drawings. The warning unit 30 is electrically connected to a power source 12 (e.g. battery of excavator 16). The warning unit 30 sends a warning to an operator of the excavator 16 if the guide arm 40 is not detected and does not send out a warning if the guide arm 40 is detected by the sensor. The warning unit 30 preferably includes a speaker 32 that provides an audible warning to the operator when the guide arm 40 is not detected by the sensor and a light 34 that provides a visual warning to the operator when the guide arm 40 is not detected by the sensor. The audible warning may be a beeping sound, a human voice stating a warning such as "The height of the boom 18 is too high" or any other warning sound. The light 34 may flash or display the text of a message (e.g. "Boom Exceeds Allowed Height").

F. Operation of Preferred Embodiment

In use, the operator of the excavator 16 operates the excavator 16 as shown in FIGS. 4 and 5 of the drawings. When the boom 18 is in a lower and safe position, the actuator 14 is in a contracted position wherein the guide arm 40 is positioned above the magnetic sensor 20 as shown in FIGS. 2 and 4 of the drawings. When the guide arm 40 is detected by the magnetic sensor 20, the warning unit 30 does not emit any warning to the operator of the excavator 16. When the boom 18 of the excavator 16 is raised above a specified level, the distal end 44 of the guide arm 40 extends past the sensor so that the sensor does not detect the guide arm 40 as shown in FIGS. 3 and 5 of the drawings. When the sensor does not detect the guide arm 40, the warning unit 30 emits a warning to the operator so the operator can terminate the raising of the boom 18 of the excavator 16.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An excavation equipment alarm system, comprising:

an excavator having a boom and an actuator with a telescoping arm;

a guide arm including a connecting end, a distal end and a length between said connecting end and said distal end, wherein said connecting end of said guide arm is attached to said telescoping arm;

a sensor attached to said actuator and positioned near said guide arm, wherein said sensor detects the presence of said guide arm; and a warning unit in communication with said sensor, wherein said warning unit sends a warning to an operator of said excavator if said guide arm is not detected.

2. The excavation equipment alarm system of claim 1, wherein said warning unit includes a speaker that provides an audible warning to said operator when said guide arm is not detected by said sensor.

3. The excavation equipment alarm system of claim 1, wherein said warning unit includes a light that provides a visual warning to said operator when said guide arm is not detected by said sensor.

4. The excavation equipment alarm system of claim 1, wherein said warning unit is electrically connected to a power source.

5. The excavation equipment alarm system of claim 1, wherein said sensor is comprised of a magnetic sensor and wherein said guide arm is comprised of a metal detectable by said magnetic sensor.

6. The excavation equipment alarm system of claim 1, including a mounting bracket attached to a body of said actuator and extending away from said body of said actuator, wherein said sensor is attached to said mounting bracket.

7. The excavation equipment alarm system of claim 1, wherein said guide arm is substantially parallel with respect to said actuator.

8. The excavation equipment alarm system of claim 1, wherein said guide arm is comprised of an elongated metal rod.

9. The excavation equipment alarm system of claim 1, including a support member attached to said body of said actuator and a guide tube attached to said support member, wherein said guide arm slidably extends through said guide tube.

10. The excavation equipment alarm system of claim 1, including a swivel joint positioned between said connecting end of said guide arm and said telescoping arm.

11. An excavation equipment alarm system, comprising:

a guide arm including a connecting end, a distal end and a length between said connecting end and said distal end, wherein said connecting end of said guide arm is attachable to a telescoping arm of an actuator on an excavator;

a sensor attached to said actuator and positioned near said guide arm, wherein said sensor detects the presence of said guide arm; and a warning unit in communication with said sensor, wherein said warning unit sends a warning to an operator of said excavator if said guide arm is not detected.

12. The excavation equipment alarm system of claim 11, wherein said warning unit includes a speaker that provides an audible warning to said operator when said guide arm is not detected by said sensor.

13. The excavation equipment alarm system of claim 11, wherein said warning unit includes a light that provides a visual warning to said operator when said guide arm is not detected by said sensor.

14. The excavation equipment alarm system of claim 11, wherein said warning unit is electrically connected to a power source.

15. The excavation equipment alarm system of claim 11, wherein said sensor is comprised of a magnetic sensor and wherein said guide arm is comprised of an elongated metal rod detectable by said magnetic sensor.

16. The excavation equipment alarm system of claim 11, including a mounting bracket attached to a body of said actuator and extending away from said body of said actuator, wherein said sensor is attached to said mounting bracket.

17. The excavation equipment alarm system of claim 11, wherein said guide arm is substantially parallel with respect to said actuator.

18. The excavation equipment alarm system of claim 11, including a support member attached to said body of said actuator and a guide tube attached to said support member, wherein said guide arm slidably extends through said guide tube.

19. The excavation equipment alarm system of claim 11, including a swivel joint positioned between said connecting end of said guide arm and said telescoping arm.

20. An excavation equipment alarm system, comprising:

an excavator having a boom and an actuator with a telescoping arm;

a guide arm including a connecting end, a distal end and a length between said connecting end and said distal end, wherein said connecting end of said guide arm is attached to said telescoping arm;

wherein said guide arm is substantially parallel with respect to said actuator;

wherein said guide arm is comprised of an elongated metal rod;

a sensor attached to said actuator and positioned near said guide arm, wherein said sensor detects the presence of said guide arm;

a warning unit in communication with said sensor, wherein said warning unit sends a warning to an operator of said excavator if said guide arm is not detected.

wherein said warning unit includes a speaker that provides an audible warning to said operator when said guide arm is not detected by said sensor;

wherein said warning unit includes a light that provides a visual warning to said operator when said guide arm is not detected by said sensor;

wherein said warning unit is electrically connected to a power source;

wherein said sensor is comprised of a magnetic sensor and wherein said guide arm is comprised of a metal detectable by said magnetic sensor;

a mounting bracket attached to a body of said actuator and extending away from said body of said actuator, wherein said sensor is attached to said mounting bracket;

a support member attached to said body of said actuator and a guide tube attached to said support member, wherein said guide arm slidably extends through said guide tube; and a swivel joint positioned between said connecting end of said guide arm and said telescoping arm.

* * * * *